US011241111B2

(12) United States Patent
McHenry

(10) Patent No.: US 11,241,111 B2
(45) Date of Patent: Feb. 8, 2022

(54) METHOD FOR POSITIONING A MAIL RECOVERY DEVICE WITHIN A MAILBOX

(71) Applicant: Mark McHenry, Terre Haute, IN (US)

(72) Inventor: Mark McHenry, Terre Haute, IN (US)

( * ) Notice: Subject to any disclaimer, the term of this patent is extended or adjusted under 35 U.S.C. 154(b) by 4 days.

(21) Appl. No.: 16/779,149

(22) Filed: Jan. 31, 2020

(65) Prior Publication Data

US 2021/0235912 A1 Aug. 5, 2021

(51) Int. Cl.
*A47G 29/12* (2006.01)
*A47G 29/122* (2006.01)

(52) U.S. Cl.
CPC ..... *A47G 29/1209* (2013.01); *A47G 29/122* (2013.01); *A47G 29/12097* (2017.08)

(58) Field of Classification Search
CPC ..... A47G 29/1209; A47G 29/12097; A47G 29/122
USPC ..... 232/17, 29, 33, 38; D99/43
See application file for complete search history.

(56) References Cited

U.S. PATENT DOCUMENTS

| | | | | |
|---|---|---|---|---|
| 4,753,385 | A | 6/1988 | Phipps et al. | |
| 5,009,366 | A * | 4/1991 | van Druff, Jr. | A47G 29/1209 232/17 |
| 5,765,749 | A * | 6/1998 | Harper | A47G 29/12097 232/17 |
| 7,451,912 | B1 * | 11/2008 | Taube, II | A47G 29/1209 232/29 |
| 8,616,435 | B2 * | 12/2013 | Crabtree | A47G 29/1209 232/29 |
| 9,675,195 | B1 * | 6/2017 | De La Nuez | A47G 29/122 |
| D858,029 | S * | 8/2019 | Jones | D99/43 |
| 2006/0022028 | A1 * | 2/2006 | Thomas | A47G 29/12097 232/29 |

* cited by examiner

*Primary Examiner* — William L Miller
(74) *Attorney, Agent, or Firm* — Ice Miller, LLP

(57) ABSTRACT

A mail recovery device for insertion into a mailbox, the device structured to adjust to the internal dimensions of the mailbox. A base member of the device rests on top of mailbox bottom surface, a pair of side members are disposed along the side surfaces of the mailbox, and a rear member is disposed along the rear surface of the mailbox. The side members include a plurality of side portions coupled together by a plurality of fold lines, while the rear member includes a plurality of rear portions coupled together by a plurality of fold lines. The fold lines are structured to provide the device with dimensional flexibility so that the size of the mail recovery device may be adjusted to the mailbox internal dimensions.

9 Claims, 4 Drawing Sheets

METHOD FOR POSITIONING A MAIL RECOVERY DEVICE WITHIN A MAILBOX

TECHNICAL FIELD OF THE DISCLOSED EMBODIMENTS

The presently disclosed embodiments generally relate to mailboxes, and more particularly, to a method for positioning a mail recovery device within a mailbox.

BACKGROUND OF THE DISCLOSED EMBODIMENTS

For many, mail is delivered to curbside mailboxes daily. Removing mail from mailboxes can be difficult if mail is placed, for example, in the rear of the mailbox and a person retrieves mail while remaining inside of a vehicle. Removing mail from mailboxes can further be made difficult by mail placement, landscaping, grouped mailboxes, mailbox in a column, and vehicle or mailbox height. In addition, stepping out of the vehicle to retrieve mail can be inconvenient, potentially unsafe, and uncomfortable in bad weather. Prior art devices have been designed in an attempt to alleviate some of these problems. Some prior art devices require a tray to slide in and out of the mailbox on tracks, for example, when the mailbox door is opened. The tray may be connected to the door and moves in and out of the mailbox on the tracks when the door is opened. In other prior art devices, the tray is coupled to tracks but not connected to the door, and the user pulls out the tray, which slides forward on the tracks. While these trays do allow for relatively easy retrieval of mail deposited in mailboxes, they suffer from certain drawbacks including rigid trays sized to fit only one mailbox size, while there are various mailbox sizes approved by the United States Postal Service. Due to the tray coupling to a track, mail has potential of getting caught between the tray and the interior of mailbox, or between the tray and the tracks. The wrong tray size can effectively make the interior of the mailbox smaller, thus limiting available space for mail. Other prior art devices allow for the size and length of the device to be adjusted by folding the sides and/or the rear sections; however, such devices require complicated junctions between the adjustable side and rear portions, making them difficult to adjust. There remains a need to overcome these and other disadvantages of prior art mail recovery devices.

SUMMARY OF THE DISCLOSED EMBODIMENTS

In one embodiment, a method for positioning a mail recovery device within a mailbox is disclosed, wherein the mailbox comprises a bottom wall, a first side wall, a second side wall opposite the first side wall, a rear wall, an access opening, and an access door; and wherein the mail recovery device comprises: a base section, the base section including first and second longitudinal side edges, a rear edge extending between the first and second longitudinal side edges at a first end of the base section, and a front edge at a second end of the base section opposite the first end, wherein a width of the base section between the first and second longitudinal side edges is less than the width of the mailbox; a first side section foldably attached to the first longitudinal side edge of the base section, wherein of the first side section includes at least one first fold line to facilitate folding the first side section along a longitudinal length of the first side section; a second side section foldably attached to the second longitudinal side edge of the base section, wherein of the second side section includes at least one second fold line to facilitate folding the second side section along a longitudinal length of the second side section; and a rear section, wherein the rear section is foldably attached to the rear edge of the base section at a rear edge fold line and wherein the rear section includes a rear section fold line dividing the rear section into a first rear portion and a second rear portion; the method for positioning the mail recovery device within the internal structure of the mailbox comprising the steps of: adjusting a longitudinal length of the mail recovery device by folding the rear section, either along the rear section fold line or along the rear edge fold line, so that at least one of the first and second rear portions is disposed beneath the base section; adjusting a width of the mail recovery device by folding the first side section along one of the first side section fold lines so that a portion of the first side section is positioned substantially orthogonal to the base section; further adjusting the width of the mail recovery device by folding the second side section along one of the second side section fold lines so that a portion of the second side section is positioned substantially orthogonal to the base section; and positioning the mail recovery device through the access opening to a position inside the mailbox, wherein the base section and at least one of the first and second rear portions rests on the bottom wall, the first side section is disposed adjacent the first side wall, and the second side section is disposed adjacent the second side wall.

In another embodiment, a mail recovery device for insertion within an enclosed cavity of a mailbox is disclosed, the device comprising: a base section, the base section including first and second longitudinal side edges, a rear edge extending between the first and second longitudinal side edges at a first end of the base section, and a front edge at a second end of the base section opposite the first end, wherein a width of the base section between the first and second longitudinal side edges is less than the width of the mailbox; a first side section foldably attached to the first longitudinal side edge of the base section, wherein of the first side section includes at least one first fold line to facilitate folding the first side section along a longitudinal length of the first side section; a second side section foldably attached to the second longitudinal side edge of the base section, wherein of the second side section includes at least one second fold line to facilitate folding the second side section along a longitudinal length of the second side section; and a rear section, wherein the rear section is foldably attached to the rear edge of the base section at a rear edge fold line and wherein the rear section includes a rear section fold line dividing the rear section into a first rear portion and a second rear portion, wherein each of the first and second rear portions comprises a shape selected from the group consisting of: an irregular hexagon and a trapezoid.

Other embodiments are also disclosed.

BRIEF DESCRIPTION OF DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
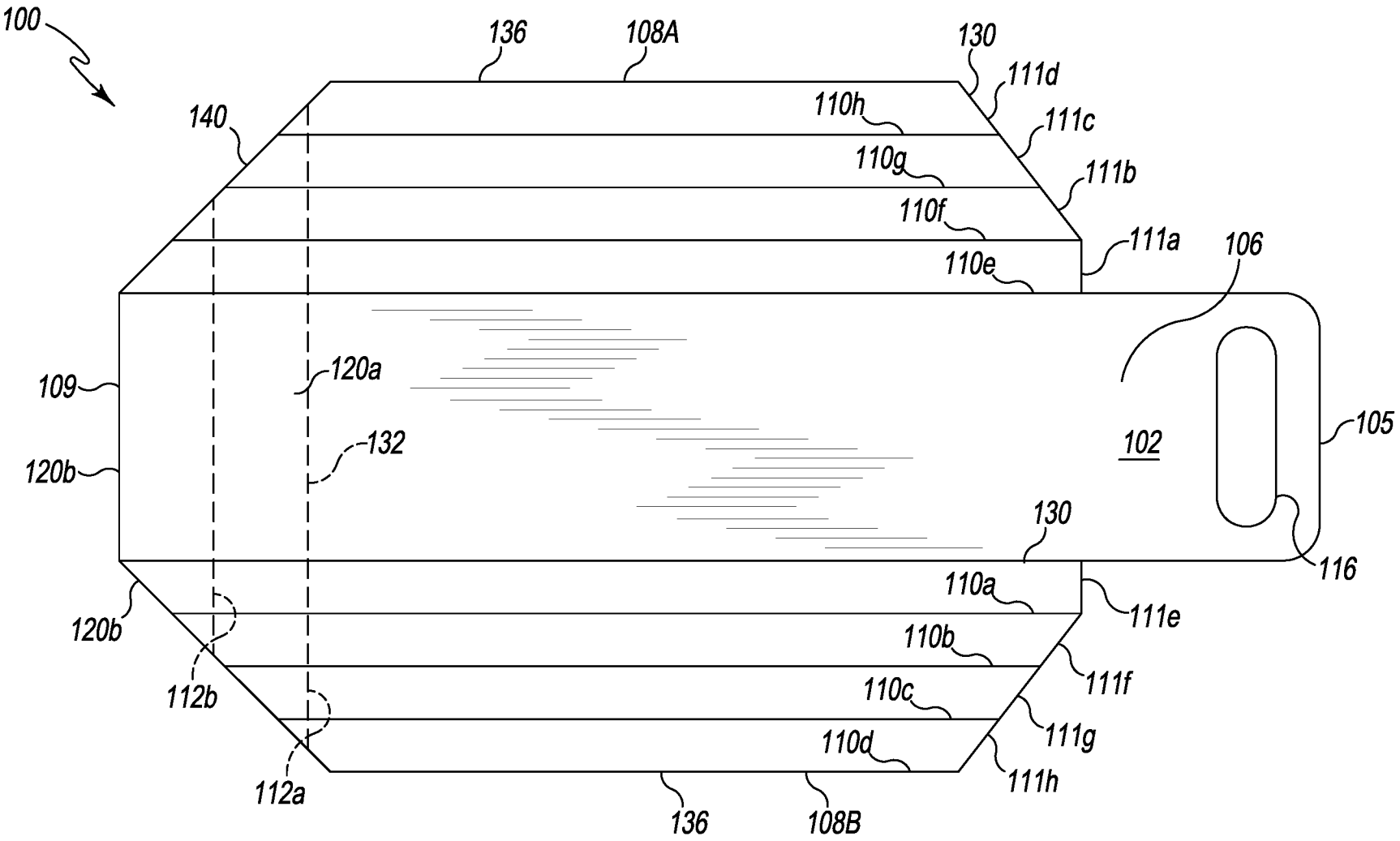
FIG. 1 is an illustration of an embodiment of the invention in the open/flat position prior to insertion into a mailbox.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

Referring to FIG. 1, an embodiment of a mail recovery device 100 may include a flexible unitary structure 102. Unitary structure 102 includes a front section 105, a base section 106, a first side section 108A, a second side section 108B, and a rear section 109. Front section 105 may include a handle 116. The unitary structure 102 may be composed of a durable material (i.e. plastic, cardboard, paperboard (for example, solid bleached board or folding box board), and the like), durable enough to maintain the structure and function under various weather and environmental conditions. A user may use the device 100 to easily gather and retrieve mail from a mailbox. For example, while sitting inside a vehicle, the user may use handle 116 to remove the device 100 partially from the mailbox, thereby drawing mail that may be resting in the rear of the mailbox toward the front of the mailbox, as will become apparent from the following description.

Unitary structure 102 may be positioned inside (i.e. slid into) a mailbox. While positioning unitary structure 102 inside the mailbox, side sections 108A and 108B, and rear section 109, may be adjusted to the internal dimensions of the mailbox. The mail recovery device 100 may be adjusted to various sizes of mailboxes approved by the United States Postal Service. Side sections 108A and 108B, and rear section 109, provide the unitary structure 102 with the flexibility to adjust to the various mailbox sizes. This flexibility of mail recovery device 100 is provided by side portions 111*a*-111*h* and side fold lines 110*a*-110*h*, combined with rear portions 120*a*-120*b* and rear edge fold line 112*a* and rear section fold line 112*b*.

The provision of side fold lines 110*a*-110*h* between side portions 111*a*-111*h*, as Well as rear edge fold line 112*a* and rear portion fold line 112*b* between rear portions 120*a*-120*b*, provide guiding means for creating folds between side portions 111*a*-111*h* of side sections 108A and 108B, and rear portions 120*a*-120*b* of rear section 109, to facilitate adjustment of the width and length of mail recovery device 100 to fit the dimensions of the interior of the mailbox. The fold lines may be formed in the unitary structure 102 by creasing, scoring, or similar operations. In other embodiments, the fold lines are simply printed guide lines on the surface of the unitary structure 102. The unitary structure 102's folding ability may be expressed by a folding factor (also called moment reduction). Folding factor 0 corresponds to uncreased paperboard, while folding factor 100% corresponds to a perfect hinge. In some embodiments, the folding factor of the fold lines 110*a*-110*h* is above 50%. In some embodiments, the folding factor of the fold lines 110*a*-110*h* is above 60%. In some embodiments, the folding factor of the fold lines 110*a*-110*h* is above 70%. Folding the unitary structure 102 along desired ones of these fold lines 110*a*-110*h* raises some or all of the side portions 111*a*-111*h* to an orientation that is substantially orthogonal to the base section 106, such that they together adjust to form a mail receiving cavity inside the mailbox. Similarly, the rear edge fold line 112*a* and rear portion fold line 112*b* between rear portions 120*a*-120*b* allow one or both of the rear portions 120*a*-120*b* to be folded down to a position below the base section 106, thereby permitting adjustment of the length of the mail recovery device 100.

Figure 2:
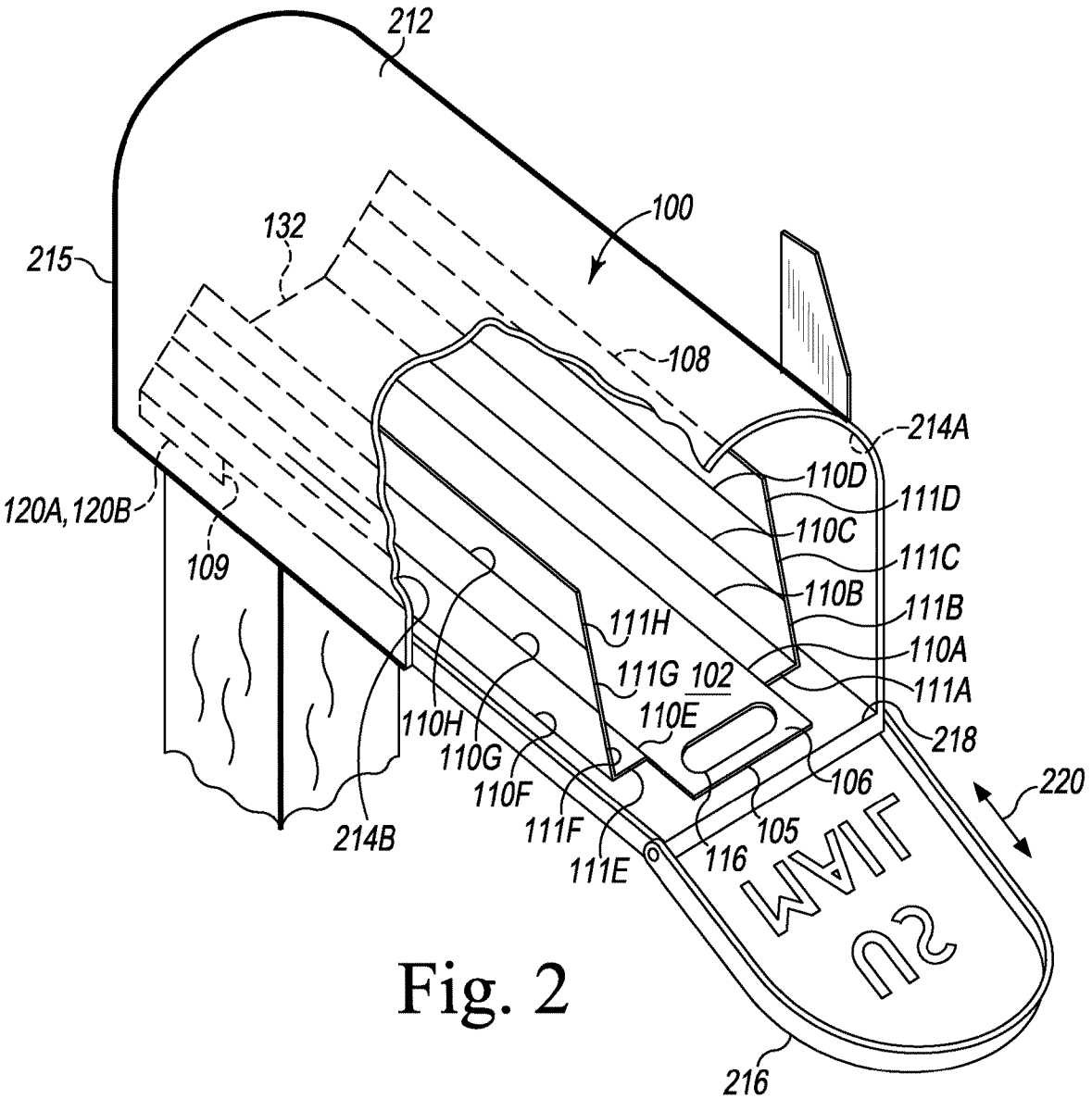
FIG. 2 is a perspective view of the invention of FIG. 1 inside of a mailbox with part of the mailbox cut away.

Referring to FIG. 2, an embodiment of mail recovery device 100 is illustrated inserted into mailbox 212. Mailbox 212 may include a bottom wall 218, a first side wall 214A, a second side wall 214B, and a rear wall 215.

As illustrated in FIG. 2, mail recovery device 100 is positioned inside of mailbox 212. The base section 106 and side portions 111A and 111E rest on top of bottom wall 218 of mailbox 212. The remaining side portions 111*b*, 111*c*, and 111*d* are disposed adjacent first side surface 214A by virtue of the unitary structure 102 having been folded at fold line 110*b*. The side portions 111*f*, 111*g*, and 111*h* are disposed adjacent second side surface 21B4 by virtue of the unitary structure 102 having been folded at fold line 110*f*.

Figure 3:
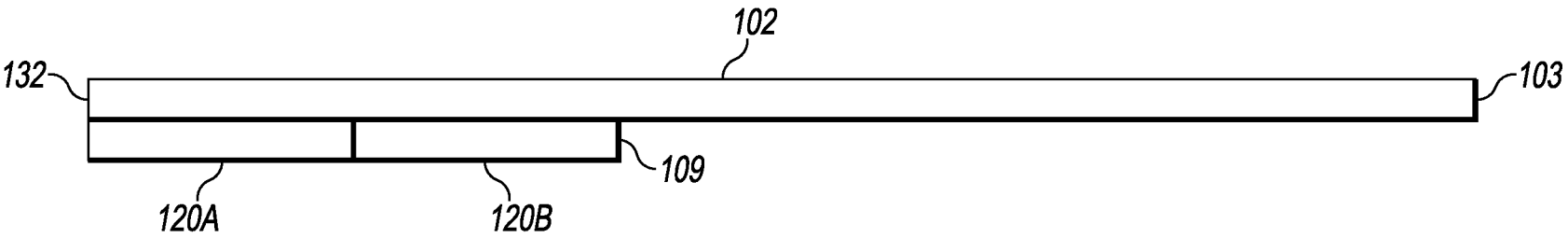
FIG. 3 is a side view of the invention of FIG. 1 with the rear section folded over the middle section.

As Illustrated in FIG. 3 the rear portions 120*a* and 120*b* fold under the base section 106 to rest between the bottom wall 218 of mailbox 212 and the base section 106 of the mail recovery device 100 by virtue of the unitary structure 102 having been folded at rear edge fold line 112*a* to remove surface area for proper fit inside of the mailbox 212. Alternatively, only rear portion 120*b* may be folded under the base section 106 to fashion a mail recovery device 102 having a longer longitudinal length conforming to mailboxes 212 having longer longitudinal lengths. The side portions 111*a*-111*h* and the rear portions 120*a* and 120*b* therefore allow mail recovery device 102 to conform to the internal dimensions of the mailbox 212. The handle 116 may be used by users to remove mail recovery device 100 from the inside of mailbox 212 through access door 216. The mail recovery device 100 may be movable in directions 220 to be placed inside of, and removed from, the mailbox 212.

Figure 4:
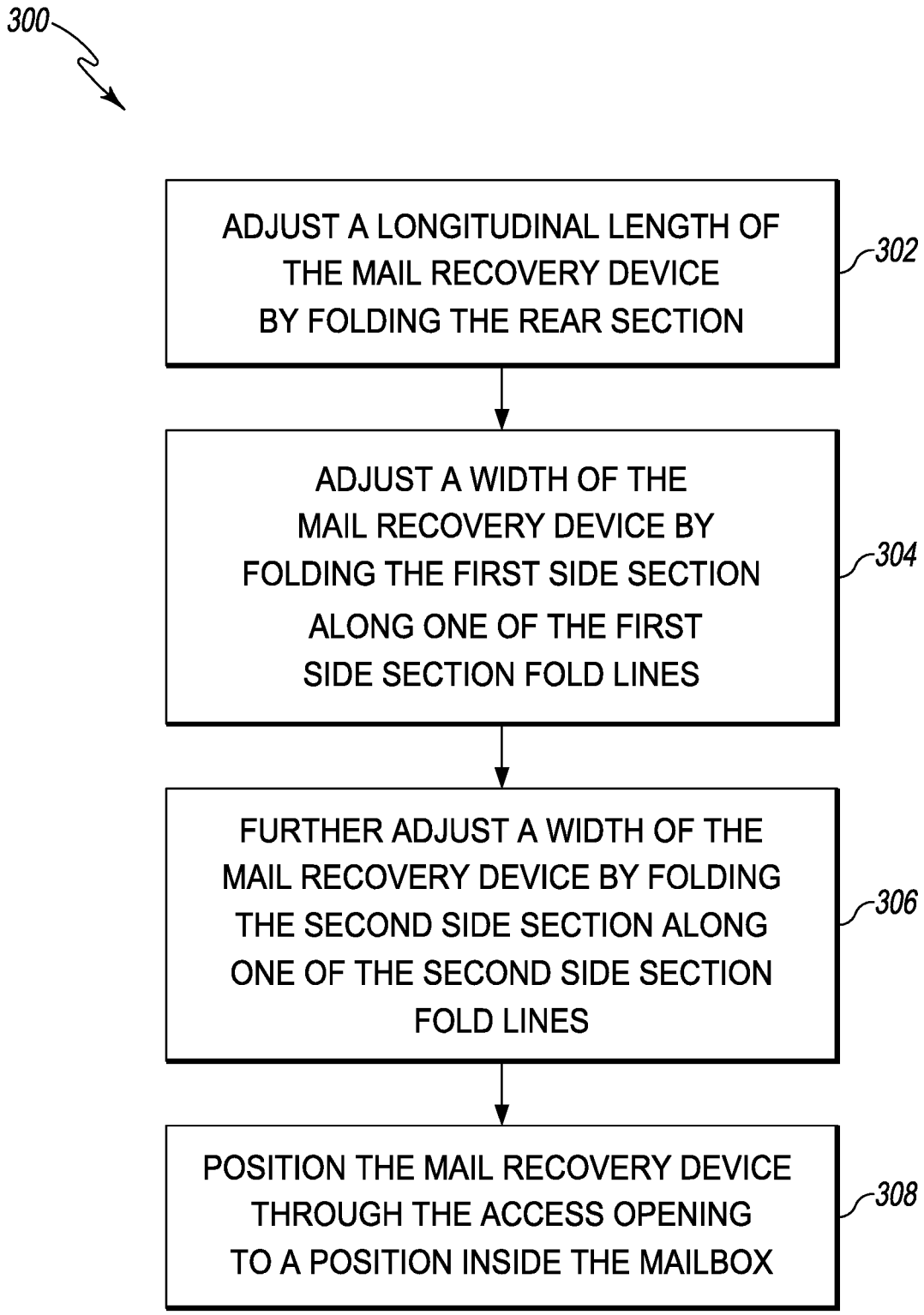
FIG. 4 is a schematic flow diagram of an embodiment method of the invention.

With reference to FIG. 4, there is schematically illustrated a flow diagram of a method 300 for positioning the mail recovery device 100 within the internal structure of the mailbox. The method starts at step 302 where a longitudinal length of the mail recovery device is adjusted by folding the rear section 109, either along the rear section fold line 112*b* or along the rear edge fold line 112*a*, so that at least one of the first and second rear portions is disposed beneath the base section.

At step 304, a width of the mail recovery device 100 is adjusted by folding the first side section 108A along one of the first side section fold lines 110 so that a portion of the first side section 108A is positioned substantially orthogonal to the base section 106.

At step 306, a width of the mail recovery device 100 is further adjusted by folding the second side section 108B along one of the second side section fold lines 110 so that a portion of the second side section 108B is positioned substantially orthogonal to the base section 106.

At step 308, the mail recovery device 100 is positioned through the access opening to a position inside the mailbox 212, wherein the base section 106 and at least one of the first and second rear portions 108 rests on the bottom wall 218, the first side section 108A is disposed adjacent the first side wall 214A, and the second side section 108B is disposed adjacent the second side wall 214B.

While the detailed description elaborates workable embodiments of the present invention, the embodiments shall not be construed as a limitation on the patented scope and claims of the present invention and, furthermore, all equivalent adaptations and modifications based on the technological spirit of the present invention shall remain protected within the scope and claims of the invention herein.

What is claimed is:

1. A method for positioning a mail recovery device within a mailbox, wherein the mailbox comprises a bottom wall, a first side wall, a second side wall opposite the first side wall, a rear wall, an access opening, and an access door; and wherein the mail recovery device comprises:

a base section, the base section including first and second longitudinal side edges, a rear edge extending between the first and second longitudinal side edges at a first end of the base section, and a front edge at a second end of the base section opposite the first end, wherein a width of the base section between the first and second longitudinal side edges is less than the width of the mailbox;

a first side section foldably attached to the first longitudinal side edge of the base section, wherein the first side section includes at least one first fold line to facilitate folding the first side section along a longitudinal length of the first side section;

a second side section foldably attached to the second longitudinal side edge of the base section, wherein the second side section includes at least one second fold line to facilitate folding the second side section along a longitudinal length of the second side section; and a rear section, wherein the rear section is foldably attached to the rear edge of the base section at a rear edge fold line and wherein the rear section includes a rear section fold line dividing the rear section into a first rear portion and a second rear portion; the method for positioning the mail recovery device within the internal structure of the mailbox comprising the steps of:

adjusting a longitudinal length of the mail recovery device by folding the rear section, either along the rear section fold line or along the rear edge fold line, so that at least one of the first and second rear portions is disposed beneath the base section;

adjusting a width of the mail recovery device by folding the first side section along one of the first side section fold lines so that a portion of the first side section is positioned substantially orthogonal to the base section;

further adjusting the width of the mail recovery device by folding the second side section along one of the second side section fold lines so that a portion of the second side section is positioned substantially orthogonal to the base section; and positioning the mail recovery device through the access opening to a position inside the mailbox, wherein the base section and at least one of the first and second rear portions rests on the bottom wall, the first side section is disposed adjacent the first side wall, and the second side section is disposed adjacent the second side wall.

2. The method of claim 1, wherein each of the first and second rear portions comprises a shape selected from the group consisting of: an irregular hexagon and a trapezoid.

3. The method of claim 1 wherein the base section includes a handle coupled to the front edge to facilitate removal of the mail recovery device from the mailbox access opening.

4. The method of claim 1 wherein the base section, first side section, second side section and rear section comprise a plastic material.

5. The method of claim 1 wherein the at least one first fold line, the at least one second fold line, the rear edge fold line, and the rear section fold line each comprise score lines.

6. A mail recovery device for insertion within an enclosed cavity of a mailbox, the device comprising:

a base section, the base section including first and second longitudinal side edges, a rear edge extending between the first and second longitudinal side edges at a first end of the base section, and a front edge at a second end of the base section opposite the first end, wherein a width of the base section between the first and second longitudinal side edges is less than the width of the mailbox;

a first side section foldably attached to the first longitudinal side edge of the base section, wherein the first side section includes at least one first fold line to facilitate folding the first side section along a longitudinal length of the first side section;

a second side section foldably attached to the second longitudinal side edge of the base section, wherein the second side section includes at least one second fold line to facilitate folding the second side section along a longitudinal length of the second side section; and a rear section, wherein the rear section is foldably attached to the rear edge of the base section at a rear edge fold line and wherein the rear section includes a rear section fold line dividing the rear section into a first rear portion and a second rear portion, wherein each of the first and second rear portions comprises a shape selected from the group consisting of: an irregular hexagon and a trapezoid.

7. The mail recovery device of claim 6 wherein the base section includes a handle coupled to the front edge to facilitate removal of the mail recovery device from the enclosed cavity.

8. The mail recovery device of claim 6 wherein the base section, first side section, second side section and rear section comprise a plastic material.

9. The mail recovery device of claim 6 wherein the at least one first fold line, the at least one second fold line, the rear edge fold line, and the rear section fold line each comprise score lines.

* * * * *